US008567662B2

(12) United States Patent
Costanzo, Jr.

(10) Patent No.: US 8,567,662 B2
(45) Date of Patent: Oct. 29, 2013

(54) METHODS AND APPARATUS RELATING TO LOCK-TOP BOX

(75) Inventor: Donn J. Costanzo, Jr., Fort Mill, SC (US)

(73) Assignee: Thatbox Design, LLC, Fort Mill, SC (US)

( * ) Notice: Subject to any disclaimer, the term of this patent is extended or adjusted under 35 U.S.C. 154(b) by 199 days.

(21) Appl. No.: 13/194,999

(22) Filed: Jul. 31, 2011

(65) Prior Publication Data

US 2013/0015235 A1 Jan. 17, 2013

Related U.S. Application Data

(60) Provisional application No. 61/508,607, filed on Jul. 15, 2011.

(51) Int. Cl.
*B65D 5/00* (2006.01)

(52) U.S. Cl.
USPC ..... 229/144; 229/117.05; 229/117.06; 229/143

(58) Field of Classification Search
USPC ..... 229/101, 117.05, 117.06, 143, 144
See application file for complete search history.

(56) References Cited

U.S. PATENT DOCUMENTS 662,619 A 11/1900 Foltz
1,075,844 A 10/1913 Miller
1,190,797 A 7/1916 Powell
2,017,129 A 10/1935 Osterberg
2,019,995 A 11/1935 Rippen
2,512,382 A 6/1950 Ringler
2,532,479 A 12/1950 Burgess
3,069,062 A * 12/1962 Keith ..... 229/139
3,119,547 A 1/1964 Nute
3,154,052 A 10/1964 Sweeney
3,199,762 A 8/1965 Coons
3,309,970 A 3/1967 Pierce
3,468,469 A * 9/1969 Kossoff et al. ..... 229/143
4,006,670 A 2/1977 Royal
4,068,795 A 1/1978 Forster
4,119,265 A 10/1978 Dlugopolski
4,272,009 A * 6/1981 Bamburg et al. ..... 229/101
4,341,341 A 7/1982 Roccaforte
4,676,428 A * 6/1987 McClure ..... 229/100
4,890,576 A 1/1990 James
4,979,669 A 12/1990 Kerton (Continued)

FOREIGN PATENT DOCUMENTS

EP 337280 A1 10/1989
WO 9611848 A1 4/1996

OTHER PUBLICATIONS

Information Disclosure Statement Letter Dated Nov. 20, 2012, submitted by applicant, 2 pages.
Canadian Application No. 2,201,965—Apr. 25, 1996—Dalvey.

*Primary Examiner* — Nathan J Newhouse
*Assistant Examiner* — Scott McNurlen
(74) *Attorney, Agent, or Firm* — Tillman Wright, PLLC; Chad D. Tillman; Jeremy C. Doerre

(57) ABSTRACT

A box having top panels that lock together to keep the box in a closed condition is disclosed. A box blank or cutout from which the box is created by folding is further disclosed.

20 Claims, 12 Drawing Sheets

(56) References Cited

U.S. PATENT DOCUMENTS

| | | | | |
|---|---|---|---|---|
| 5,020,337 | A | 6/1991 | Krieg | |
| 5,062,527 | A | 11/1991 | Westerman | |
| 5,094,359 | A | 3/1992 | DeMars et al. | |
| 5,284,294 | A | 2/1994 | Floyd | |
| 5,303,863 | A | 4/1994 | Arasim | |
| 5,307,986 | A | 5/1994 | Schuster | |
| 5,562,228 | A | 10/1996 | Ericson | |
| 6,164,526 | A | 12/2000 | Dalvey | |
| 6,386,441 | B2 * | 5/2002 | Philips | 229/143 |
| 6,736,309 | B1 | 5/2004 | Westerman et al. | |
| 6,837,420 | B2 | 1/2005 | Westerman et al. | |
| 6,988,653 | B2 * | 1/2006 | Bell | 229/117.05 |
| 7,841,512 | B2 | 11/2010 | Westerman et al. | |
| 7,870,995 | B1 | 1/2011 | Kaltman et al. | |
| 8,343,024 | B1 * | 1/2013 | Costanzo et al. | 493/128 |
| 8,348,819 | B1 * | 1/2013 | Costanzo et al. | 493/126 |
| 8,348,820 | B2 * | 1/2013 | Costanzo et al. | 493/128 |
| 8,348,821 | B2 * | 1/2013 | Costanzo et al. | 493/128 |
| 2006/0032899 | A1 * | 2/2006 | Bell | 229/117.05 |
| 2008/0110964 | A1 * | 5/2008 | Churvis | 229/100 |
| 2008/0290149 | A1 | 11/2008 | Sweet | |

* cited by examiner

METHODS AND APPARATUS RELATING TO LOCK-TOP BOX

CROSS-REFERENCE TO RELATED APPLICATION

The present application is a nonprovisional patent application of, and claims priority under 35 U.S.C. §119(e) to, U.S. provisional patent application Ser. No. 61/508,607, filed Jul. 15, 2011, which '607 application is incorporated herein by reference. The present application furthermore hereby incorporates by reference the following U.S. patent applications, any publications thereof, and any patents issuing therefrom: U.S. patent application Ser. No. 13/049,890; and U.S. PA 61/452,640.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally pertains to apparatus and methods relating to corrugated materials, containers and packaging.

Patents illustrative of the background of the invention include, for example, U.S. Pat. Nos. 5,062,527; 5,094,359; 5,263,339; 5,284,294; 5,582,343; 6,164,526; 6,736,309; 6,837,420; and 7,841,512.

It is believed that a need exists for improvement in apparatus and methods relating to corrugated materials, containers and packaging. This, and other needs, are addressed by one or more aspects and features of the present invention.

SUMMARY OF THE INVENTION

The present invention includes many aspects and features. Moreover, while many aspects and features relate to, and are described in, the context apparatus and methods relating to corrugated materials, containers and packaging, the present invention is not necessarily limited to use only in such apparatus and methods, as will become apparent from the following summaries and detailed descriptions of aspects, features, and one or more embodiments of the present invention. Indeed, materials other than corrugated materials could be used, for example.

Accordingly, an aspect of the present invention relates to a box cutout.

In a feature of this aspect, the box cutout includes flanges and a tab.

In another aspect, a box cutout includes: a front panel including two attachment panels extending therefrom and connected at a respective fold line therewith; a back panel including two attachment panels extending therefrom and connected at a respective fold line therewith; first and second side panels; a bottom panel to which the front panel, back panel, and each of the side panels are connected at a fold line; a first top panel having flanges on opposite sides connecting the first top panel at fold lines to respective attachment panels of the front panel; and a second top panel having flanges on opposite sides connecting the second top panel at fold lines to respective attachment panels of the back panel.

In a feature of this aspect, one of the top panels includes a tab and the other top panel does not include a tab.

In additional features of this aspect, one of the top panels includes a tab and the other top panel does not include a tab; and the flanges of the top panel that includes the tab extends to outer edges of the attachment panels and to the outer edge of such top panel; and the flanges of the top panel that does not include a tab do not extend to outer edges of the attachment panels and does not extend to the outer edge of such top panel. The flanges and tab result in the locking of the top panels when the box cutout is folded into a box with the top panels in a closed position.

Another aspect of the present invention relates to a method of transitioning a box cutout into a box configuration in which the top panels of the box lock together to keep the box in a closed condition.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein like elements are referred to with like reference numerals.

FIG. 1*a* is a photograph of a box in an expanded box configuration, wherein the top of the box is locked in a closed position, in accordance with an embodiment of the present invention.

FIG. 2*a* is a photograph of a first side of the box of FIG. 1*a* in an expanded box configuration, wherein the top of the box is in an open position, in accordance with an embodiment of the present invention.

FIG. 3*a* is a photograph of the opposite side of the box of FIG. 1*a* in an expanded box configuration, wherein the top of the box is in an open position, in accordance with an embodiment of the present invention.

FIG. 4*a* is a photograph of the box of FIG. 3*a*, wherein a first panel of the top of the box is folded downward, in accordance with an embodiment of the present invention.

FIG. 5*a* is a photograph of the box of FIG. 4*a*, wherein a second, opposite panel of the top of the box is being folded downward, in accordance with an embodiment of the present invention.

FIG. 6*a* is a photograph of the box of FIG. 5*a*, wherein the second, opposite panel of the top of the box is positioned on top of the first panel of the top of the box, in accordance with an embodiment of the present invention.

FIG. 7*a* is a perspective view of the box of FIG. 6*a*, wherein a tab on the second, opposite panel of the top of the box has been pushed down under the first panel of the top of the box, in accordance with an embodiment of the present invention.

DETAILED DESCRIPTION

Figure 1:
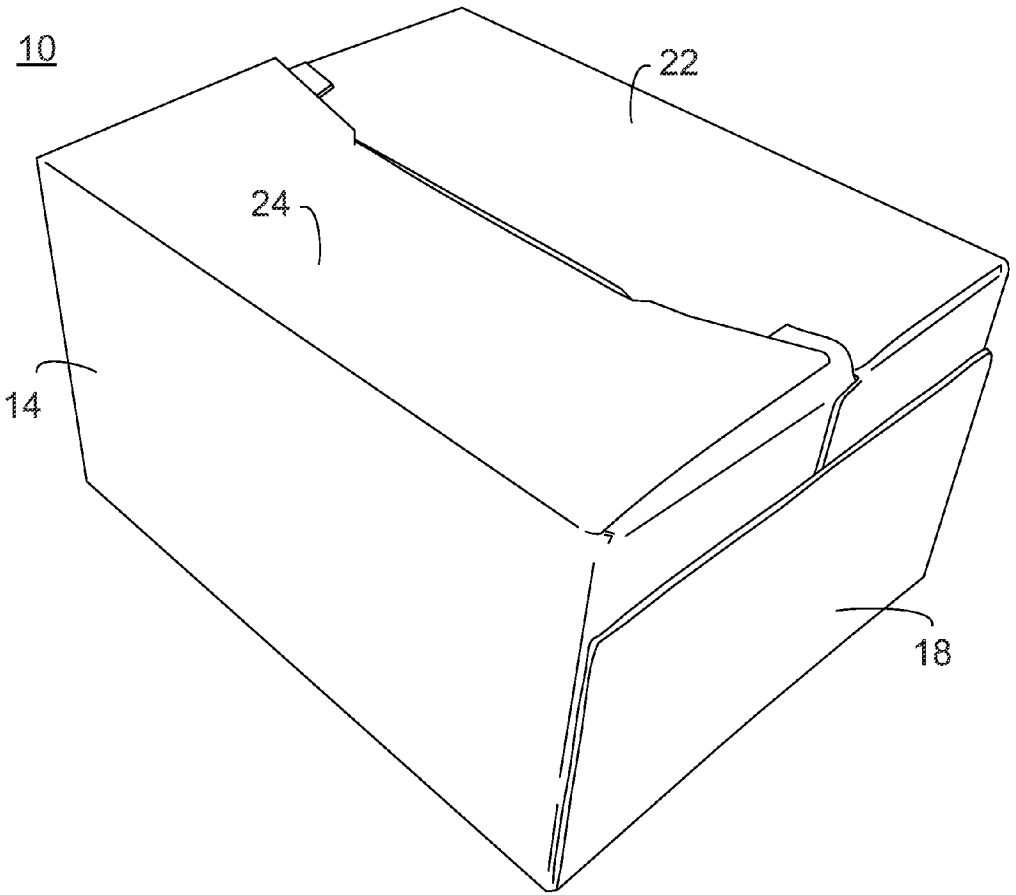
FIG. 1 illustrates a perspective view of a box in an expanded box configuration, wherein the top of the box is locked in a closed position, in accordance with an embodiment of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Additionally, as used herein, a "score line" is intended to mean an elongated area along which a fold is predisposed to form upon application of force. Within this broader context, a score line may be a generally linear area of weakness formed in a corrugated or non-corrugated panel along which the panel is predisposed to fold upon application of a force on the panel. A score line may be formed by way of example, and not limitation, by notching, scratching, incision, compression, perforation, physical deformation, or otherwise.

Referring now to the drawings, one or more preferred embodiments of the present invention are next described. The following description of one or more preferred embodiments is merely exemplary in nature and is in no way intended to limit the invention, its implementations, or uses.

Figure 2:
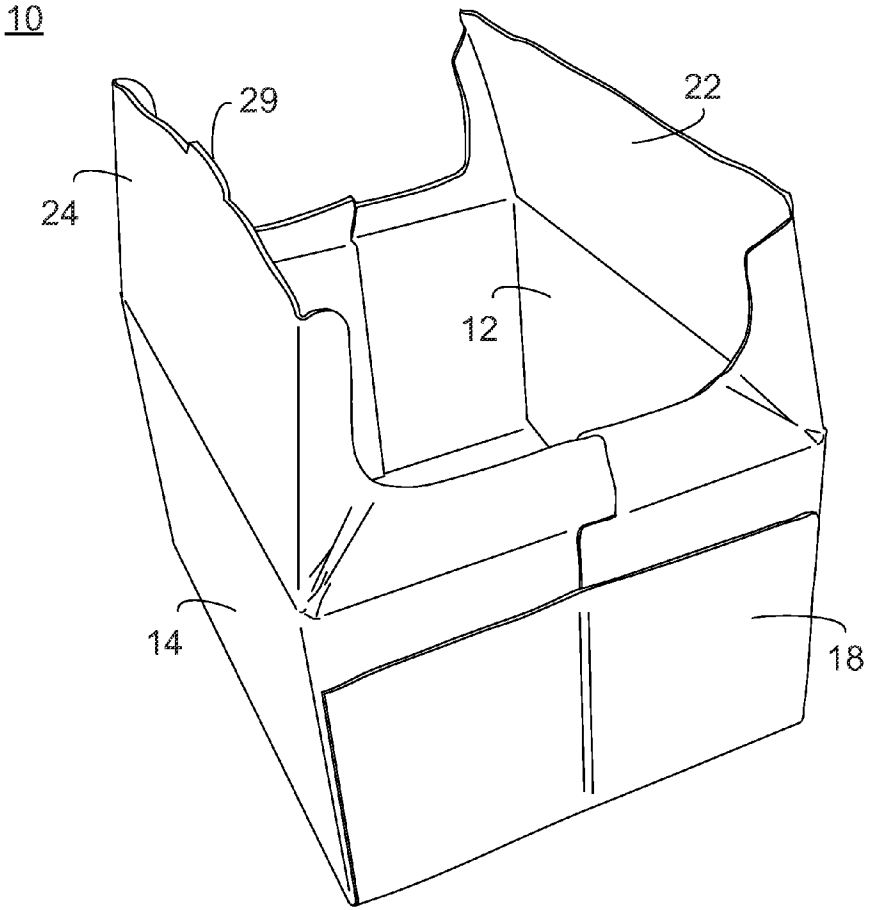
FIG. 2 is a perspective view of a first side of the box of FIG. 1 in an expanded box configuration, wherein the top of the box is in an open position, in accordance with an embodiment of the present invention.
Figure 3:
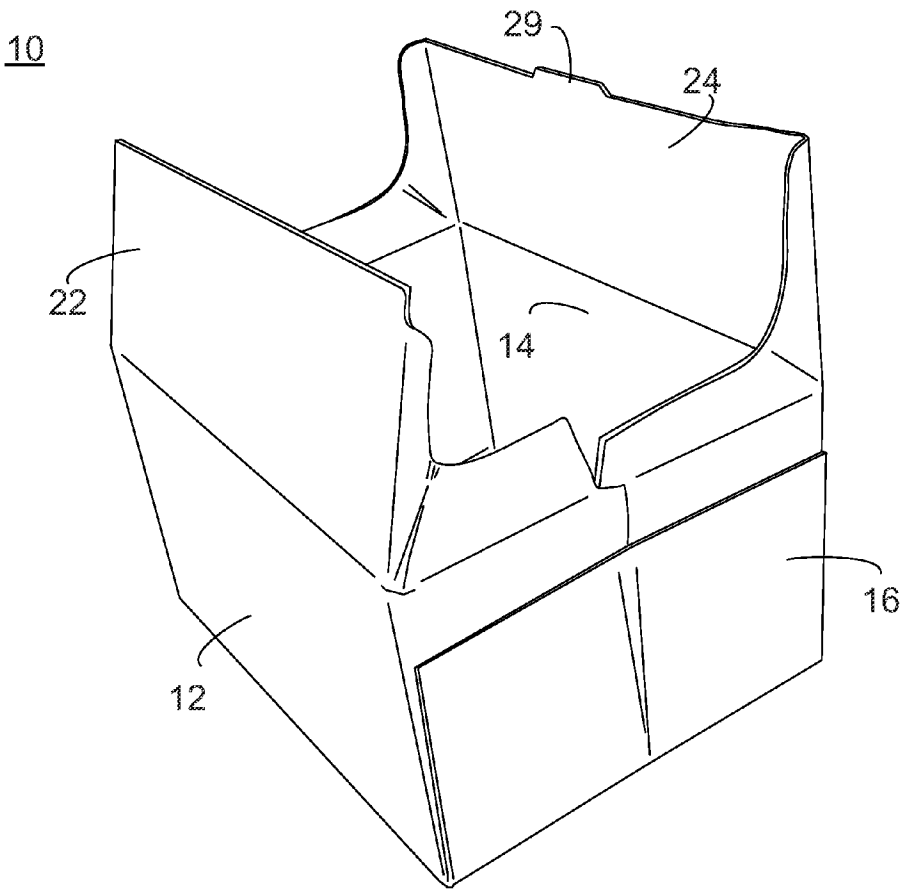
FIG. 3 is a perspective view of the opposite side of the box of FIG. 1 in an expanded box configuration, wherein the top of the box is in an open position, in accordance with an embodiment of the present invention.
Figure 4:
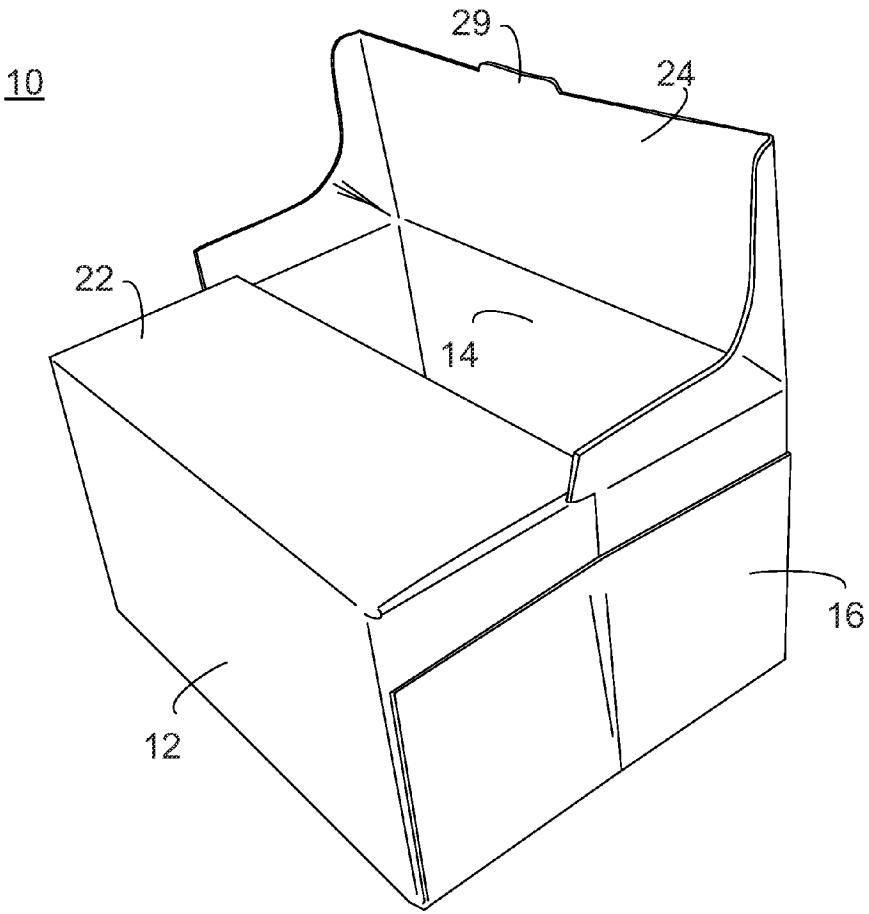
FIG. 4 is a perspective view of the box of FIG. 3, wherein a first panel of the top of the box is folded downward, in accordance with an embodiment of the present invention.

Turning now to the drawings, FIG. 1 illustrates a perspective view of a box 10 in an expanded box configuration for use. As shown, the top of the box is locked in a closed position. FIG. 2 is a perspective view of the box 10 in the expanded box configuration for use, with the top of the box 10 in an open position. FIG. 3 is a perspective view of the other side of the box 10 of FIG. 2. In transitioning from this open position of FIG. 3 to the closed and locked position of FIG. 1, a first panel 22 of the top of the box 10 is folded downward to the position shown in FIG. 4.

Figure 5:
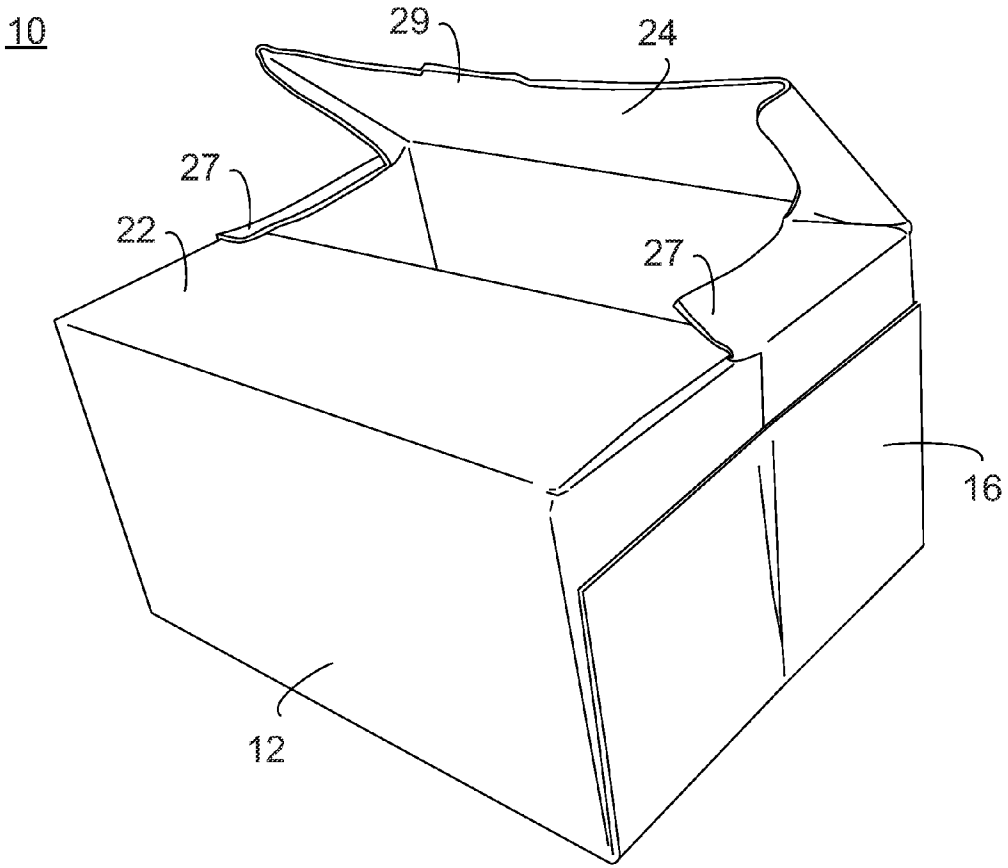
FIG. 5 is a perspective view of the box of FIG. 4, wherein a second, opposite panel of the top of the box is being folded downward, in accordance with an embodiment of the present invention.
Figure 6:
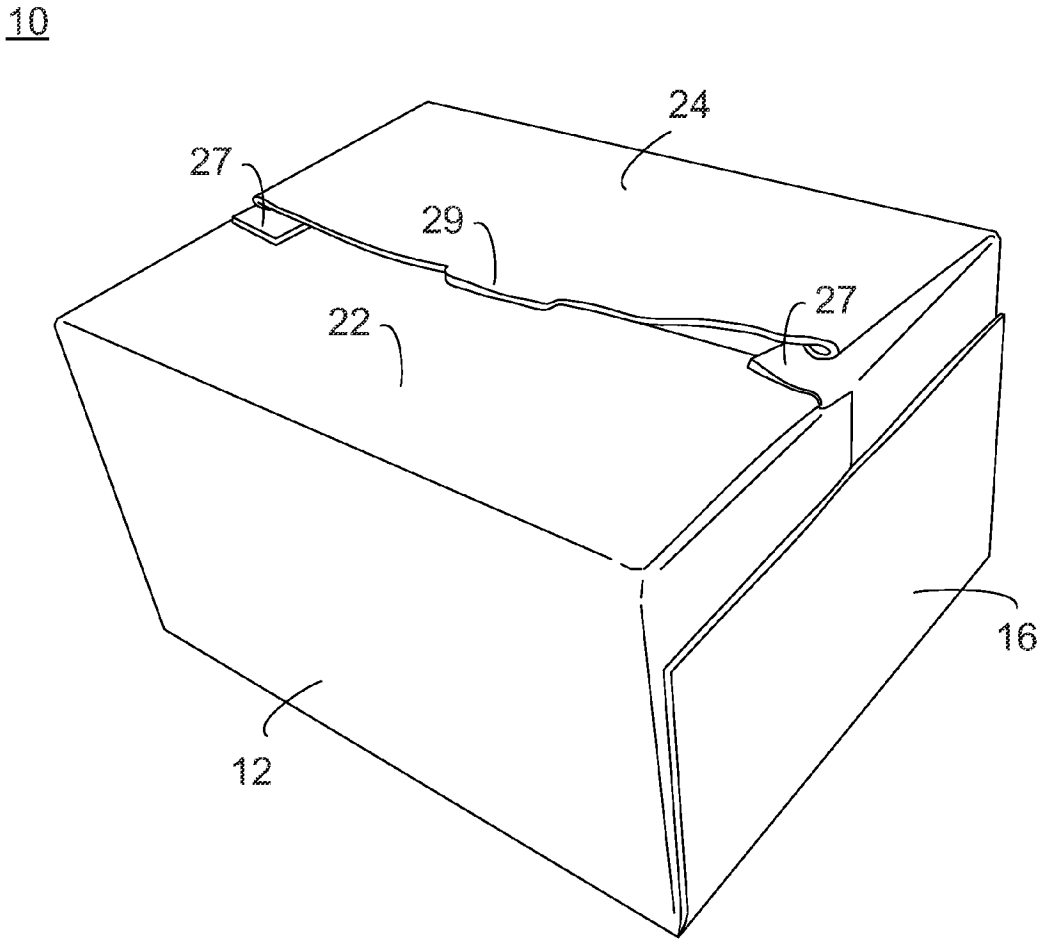
FIG. 6 is a perspective view of the box of FIG. 5, wherein the second, opposite panel of the top of the box is positioned on top of the first panel of the top of the box, in accordance with an embodiment of the present invention.

Importantly, the top panel 22 that does not include a tab 29 is the panel that is folded into the closed position first. The other panel 24 having the tab 29 is folded secondly, as represented in FIGS. 5-6. In so folding, the flanges 27 of the top panel 24 folded subsequent to the folding downwardly of the first panel 22 are folded over the top panel 22 folded first, as clearly shown in FIGS. 5-7.

Thereafter, the tab 29 of the second panel 24 is pushed down under the first top panel 22, thereby resulting in a binding and consequent locking of the first and second top panels 22,24 together in the closed position.

Figure 7:
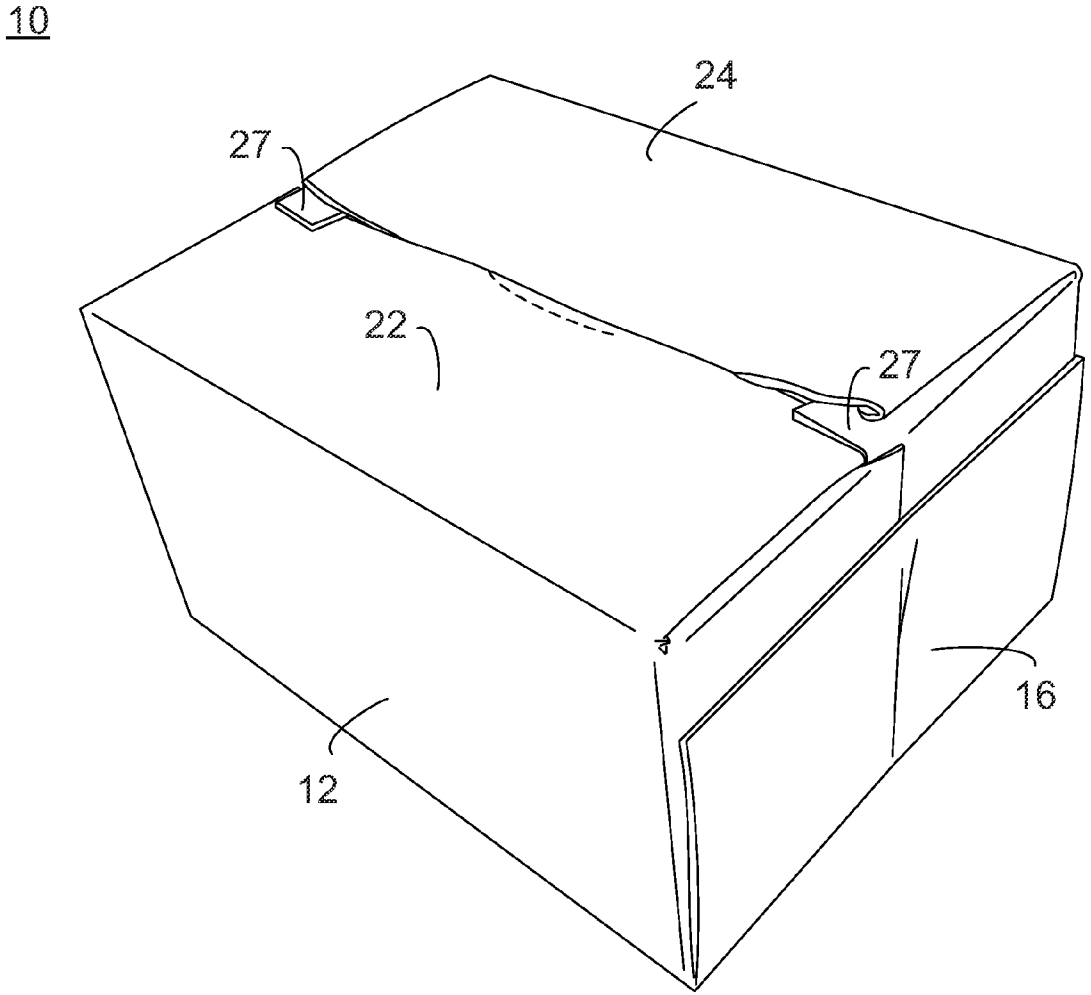
FIG. 7 is a perspective view of the box of FIG. 6, wherein a tab on the second, opposite panel of the top of the box has been pushed down under the first panel of the top of the box, in accordance with an embodiment of the present invention.

Notably, as shown in FIG. 7, the top panel 22 that does not include the tab 29 is positioned in-between the tab 29 (shown in phantom) and the flanges 27 of the other top panel 24, with the tab 29 abutting an underside of the top panel 22 near the center of the box 10 and the flanges 27 abutting the topside of the top panel 22 near the side panels 16,18 of the box 10.

FIGS. 1*a*-7*a* of U.S. patent application publication No. 2013/0015235, which is incorporated herein by reference, track FIGS. 1-7 and represent photographs from which FIGS. 1-7 were created.

Figure 8:
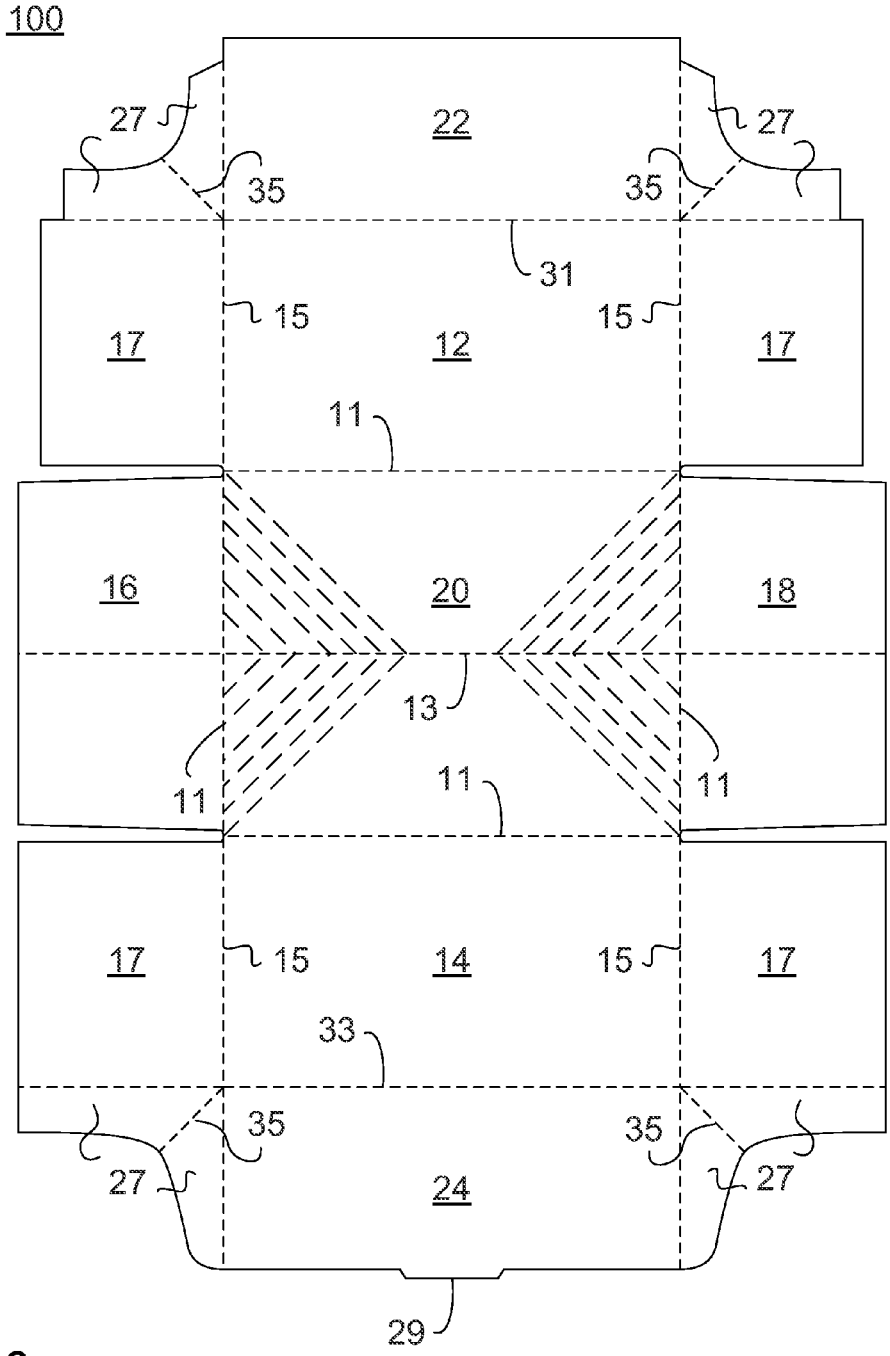
FIG. 8 illustrates a top plan view of a box cutout in accordance with a preferred embodiment of the present invention.

FIG. 8 illustrates a blank, or more specifically, a box cutout 100 in accordance with a preferred embodiment of the present invention from which the box 10 is created in a folding and gluing process. The box cutout 100 comprises corrugated cardboard pre-cut in a shape configured to allow the box cutout 100 to be manipulated to form a container, and more specifically, the box 10 represented by FIGS. 1-7. It will be appreciated, however, that other materials may be utilized for the cutout. For example, in one or more preferred implementations, a blank may comprise paper or plastic, may be comprised of corrugated or non-corrugated material, or may comprise any material commonly utilized for containers used in packaging, shipping, or storage.

More specifically, FIG. 8 illustrates an surface of the box cutout 100 that will form the inner surfaces of the box 10. The box cutout 100 includes front and back panels 12,14, side panels 16,18, and a bottom panel 20. Each of the front and back panels 12,14 and side panels 16,18 can be characterized as extending from the bottom panel 20 and being separated from the bottom panel 20 by a respective score line 11. Another score line 13 bisects each of the side panels 16,18 and the bottom panel 20.

Each of the front and back panels 12,14 includes two attachment panels 17 extending therefrom that are each separated therefrom by a respective score line 15. In at least some implementations, each set of two score lines 15 and one score line 11 are segments of, and collective form, a single score line running the width of box cutout 100, just as score line 13 does.

Each of score lines 11,13,15 facilitates folding of the box cutout 100 along that score line. The box cutout 100 is configured such that the scores lines 11,15 facilitate transitioning of the box cutout 100 into a box configuration, and the score line 13 facilitates transitioning of the box between an expanded box configuration and a collapsed box configurations.

Additionally, the box cutout 100 further includes a first top panel 22 and a second top panel 24, each having flanges 27 connection the respective top panel to a respective attachment panel 17. Score line 31 extends between top panel 22 and front panel 12, and score line 33 extends between top panel 24 and rear panel 14. Furthermore, a respective score line 35 extends within and divides adjacent flanges 27.

Figure 9:
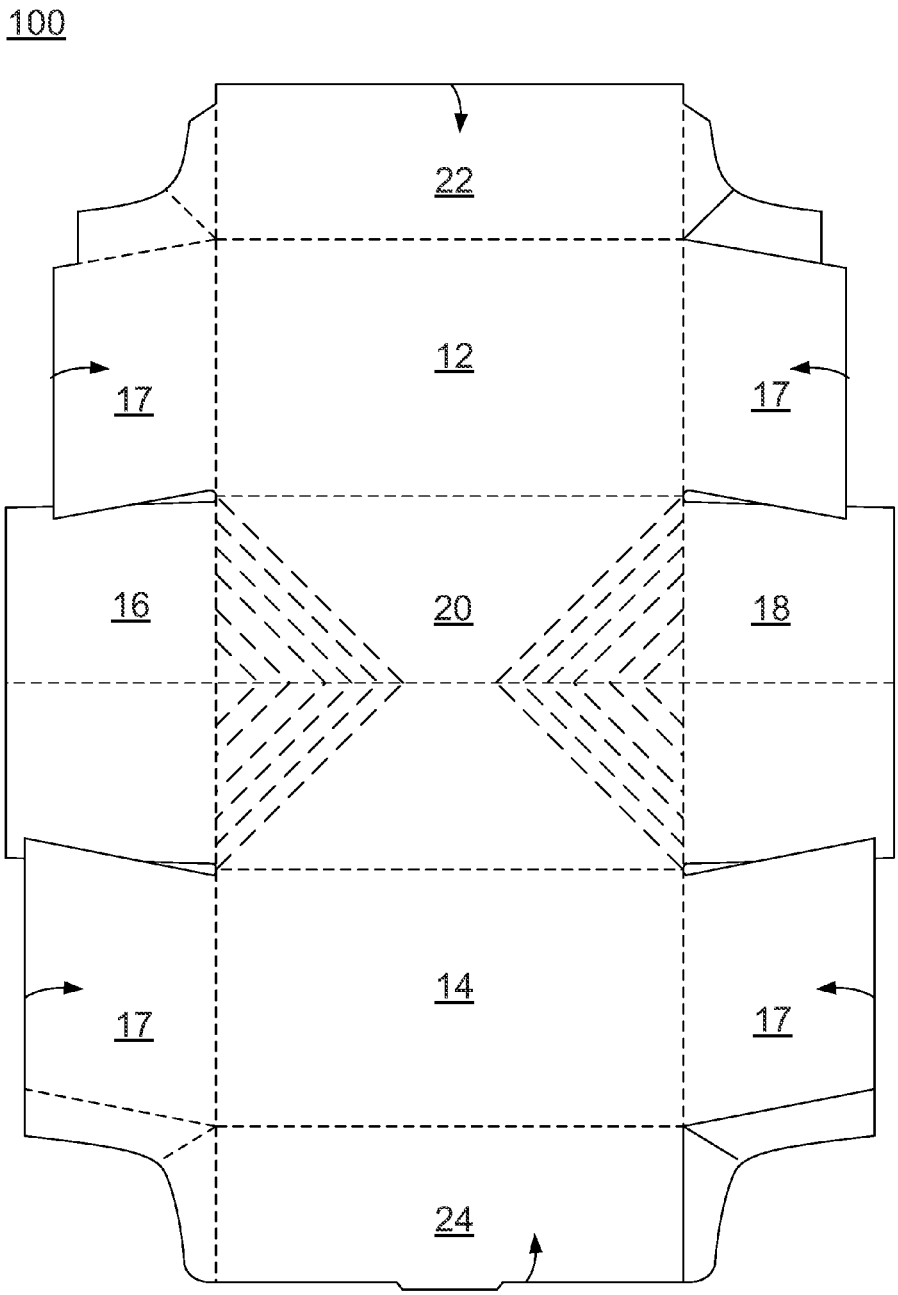
FIGS. 9-11 illustrate folding of the box cutout of FIG. 8 into a collapsed box configuration in accordance with a preferred embodiment of the present invention.
Figure 10:
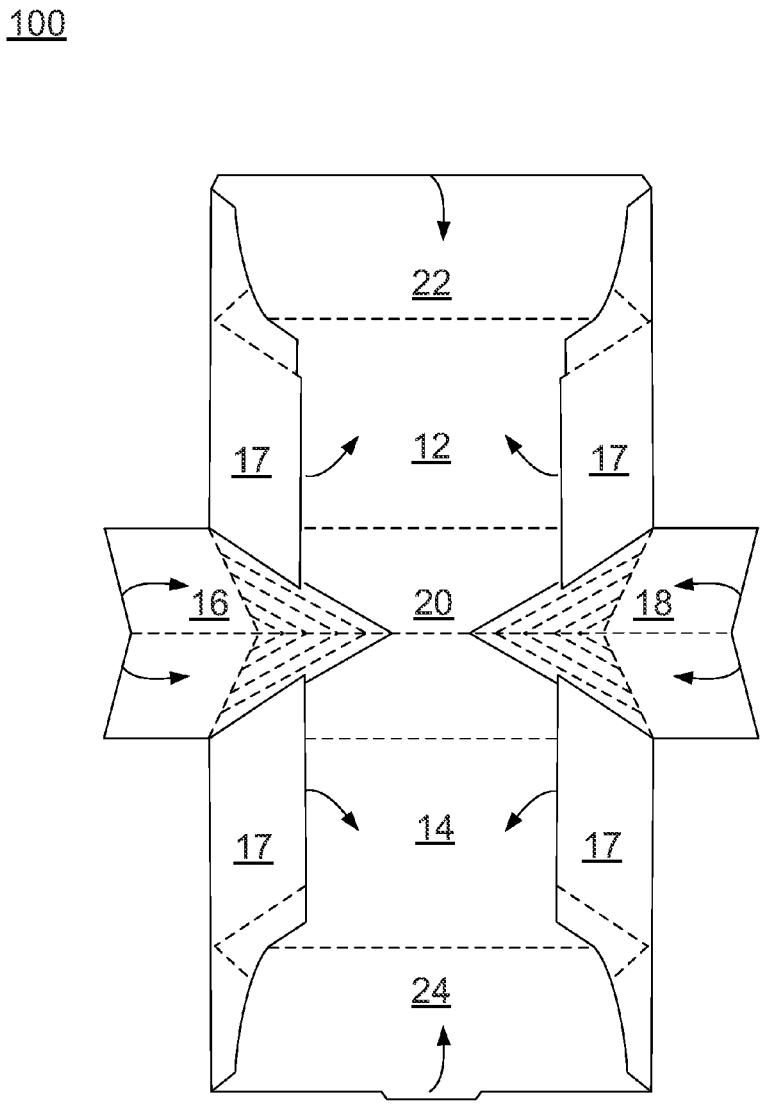
Figure 11:
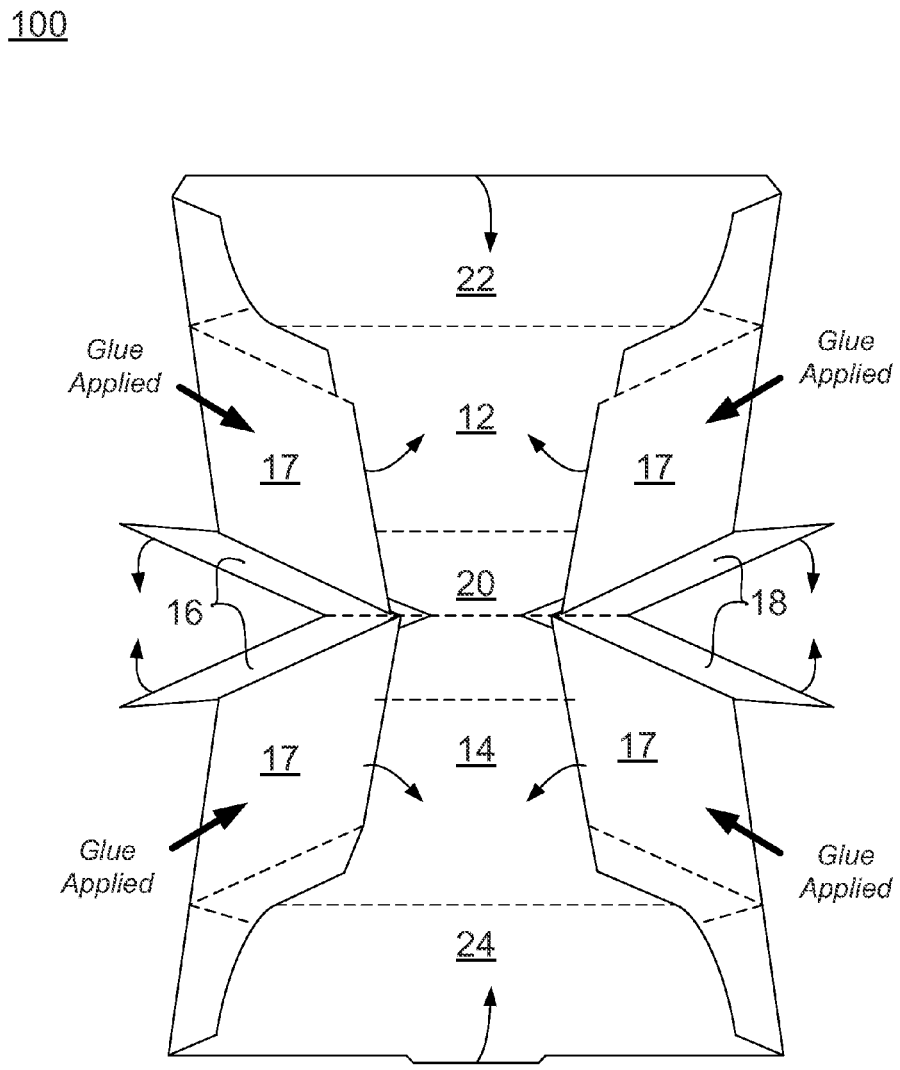
Figure 12:
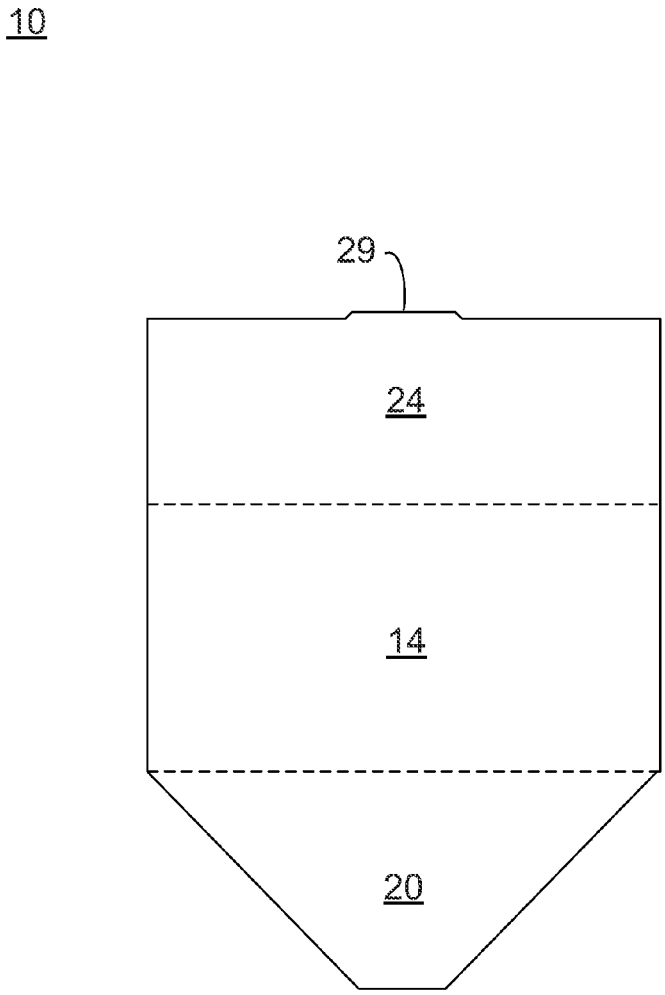
FIG. 12 illustrates a side elevational view of the box cutout of FIG. 8 folded into a collapsed box configuration as a result of the sequence represented by FIGS. 9-11.

Folding of the score lines and creation of the box 10 from the box cutout 100 is illustrated in FIGS. 9-11. During folding, glue is applied for securing attachment panels 17 to side panels 16,18. Alternatively, or in addition, another adhesive or other manner for securing the panels together is utilized. The result is an assembled box in a collapsed configuration prior to use, as shown in FIG. 12. This configuration is sometimes referred to as a "knock-down" configuration of the box 10.

In accordance with an aspect of the invention, one of the top panels 24 of the box cutout 100 further includes a tab 29 (top panel 24 as illustrated). It will be appreciated that the flanges and tab, as well as the folding method illustrated, result in the locking of the top panels 22,24 when the resulting box 10 is in the expanded box configuration with the top panels 22,24 in the closed position of FIGS. 1 and 7.

It will further be appreciated from inspection of FIG. 8 that the flanges 27 of the top panel 24 having the tab 29 extend to outer edges of the attachment panels 17 and extend to the outer edge of such top panel 24. In contrast, the flanges 27 of the top panel 22 that does not include a tab do not extend to outer edges of the attachment panels 17 and do not extend to the outer edge of such top panel 22.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A box cutout, comprising:

(a) a front panel including two attachment panels extending therefrom and connected at a respective fold line therewith;

(b) a back panel including two attachment panels extending therefrom and connected at a respective fold line therewith;

(c) first and second side panels;

(d) a bottom panel to which the front panel, back panel, and each of the side panels are connected at a fold line;

(e) a first top panel having flanges on opposite sides connecting the first top panel at fold lines to respective attachment panels of the front panel; and (f) a second top panel having flanges on opposite sides connecting the second top panel at fold lines to respective attachment panels of the back panel;

(g) wherein one of the top panels includes a tab and the other top panel does not include a tab;

(h) wherein the flanges of the top panel that includes the tab extend to outer edges of the attachment panels and to the outer edge of such top panel;

(i) wherein the flanges of the top panel that does not include a tab do not extend to outer edges of the attachment panels and do not extend to the outer edge of such top panel; and (j) wherein the flanges and tab are configured for locking of the top panels when the box cutout is folded into a box with the top panels in a closed position.

2. The box cutout of claim 1, wherein each fold line comprises a score line.

3. The box cutout of claim 1, wherein a first subset of the fold lines facilitates transitioning of the box cutout into a box by folding therealong, and a second subset of the fold lines facilitates, by folding therealong, transitioning the box from an expanded configuration for use to a collapsed configuration for storage or transport of the box when empty.

4. A method of transitioning a box from a first box configuration, in which the box is open, to a second box configuration, in which the box is closed, the box comprising a front connected to two front attachment panels, a back connected to two back attachment panels, first and second sides, a bottom, a first top panel connected to the front having flanges on opposite sides, each of the flanges being respectively connected to one of the front attachment panels, and a second top panel having flanges on opposite sides, each of the flanges being respectively connected to one of the back attachment panels; wherein one of the top panels includes a tab and the other top panel does not include a tab; wherein the flanges of the top panel that includes the tab extend to the outer edge of such top panel; wherein the flanges of the top panel that does not include a tab do not extend to the outer edge of such top panel; wherein the flanges and tab are configured to allow for the locking of the top panels in a closed configuration when the top panels are folded downward to cover a top opening of the box, the top opening being defined by the front, back, and first and second sides; and wherein the method comprises the steps of:

(a) folding downwardly the first top panel of the box;

(b) folding downwardly the second top panel of the box such that flanges of the second top panel overlie the first top panel and the tab of the second top panel overlies the first top panel; and (c) securing the first and second top panels of the box in a closed position by causing the tab to extend below the first top panel such that the first top panel is disposed in-between the tab and the flanges of the second top panel, with the tab abutting an underside of the first top panel and the flanges abutting a topside of the first top panel, resulting in a binding and consequent locking of the first and second top panels together in the closed position.

5. The method of claim 4, wherein said step (c) comprises depressing the panels proximate a center of the box where the panels meet until the tab clears the edge of the first top panel and extends below the first top panel.

6. The method of claim 5, wherein the first top panel does not include a tab.

7. The method of claim 4, wherein the method further includes forming the box from a box cutout by folding the box cutout along a plurality of fold lines.

8. The method of claim 7, wherein each fold line comprises a score line.

9. The method of claim 7, wherein a first subset of the fold lines facilitates transitioning of the box cutout into a box by folding therealong, and a second subset of the fold lines facilitates, by folding therealong, transitioning the box from an expanded configuration for use to a collapsed configuration for storage or transport of the box when empty.

10. The box cutout of claim 1, wherein the tab extends from a central portion of an edge of the top panel that includes the tab.

11. The box cutout of claim 3, wherein the first and second top panels are sized and dimensioned to, upon transitioning of the box cutout to a box, overlap when the first and second top panels are folded downwards to cover a top opening of the box.

12. The method of claim 4, wherein said step of folding downwardly the first top panel of the box comprises folding the first top panel of the box downward to partially cover a top opening of the box.

13. The method of claim 12, wherein the first top panel of the box, when folded downward, covers around half of the top opening of the box.

14. The method of claim 12, wherein said step of folding downwardly the second top panel of the box comprises folding the second top panel of the box downward such that the first and second top panels of the box collectively generally cover the entire top opening of the box.

15. The method of claim 14, wherein the first top panel of the box and the second top panel of the box, when folded downward to generally cover the top opening, overlap one another.

16. A box, comprising:

(a) a front connected to two front attachment panels;

(b) a back connected to two back attachment panels;

(c) first and second sides;

(d) a bottom;

(e) a first top panel connected to the front having flanges on opposite sides, each of the flanges being respectively connected to one of the front attachment panels; and (f) a second top panel having flanges on opposite sides, each of the flanges being respectively connected to one of the back attachment panels;

(g) wherein one of the top panels includes a tab and the other top panel does not include a tab;

(h) wherein the flanges of the top panel that includes the tab extend to the outer edge of such top panel;

(i) wherein the flanges of the top panel that does not include a tab do not extend to the outer edge of such top panel; and (j) wherein the flanges and tab are configured to allow for the locking of the top panels in a closed configuration when the top panels are folded downward to cover a top opening of the box, the top opening being defined by the front, back, and first and second sides.

17. The box of claim 16, wherein the box includes a plurality of fold lines and is configured to be transitioned to a substantially flat configuration via folding along at least some of the plurality of fold lines.

18. The box of claim 17, wherein at least some of the fold lines comprise score lines.

19. The box of claim 16, wherein the tab extends from a central portion of an edge of the top panel that includes the tab.

20. The box of claim 16, wherein the first and second top panels are sized and dimensioned to overlap when the first and second top panels are folded downwards to cover the top opening of the box.

* * * * *